United States Patent [19]

Herchenbach et al.

[11] 4,147,503

[45] Apr. 3, 1979

[54] GRID COOLER, PARTICULARLY FEED STEP GRID COOLER

[75] Inventors: Horst Herchenbach, Troisdorf; Richard Schneider, Bonn-Bad Godesberg, both of Fed. Rep. of Germany

[73] Assignee: Klöckner-Humboldt-Deutz AG, Fed. Rep. of Germany

[21] Appl. No.: 837,296

[22] Filed: Sep. 27, 1977

[30] Foreign Application Priority Data

Oct. 9, 1976 [DE] Fed. Rep. of Germany ..... 2645670

[51] Int. Cl.[2] ..... F27D 15/02

[52] U.S. Cl. ..... 432/78; 432/80; 34/20; 198/773; 198/774

[58] Field of Search ..... 432/78, 80, 85, 14, 432/58, 103, 106, 117, 79, 82; 106/101, 100; 34/164, 20, 13, 62; 198/773, 774, 865

[56] References Cited

U.S. PATENT DOCUMENTS

| | | | |
|---|---|---|---|
| 2,728,443 | 12/1955 | Pike, Jr. et al. | 198/773 |
| 3,170,775 | 2/1965 | Howell, Jr. | 34/20 |
| 3,197,887 | 8/1965 | Kayatz | 34/20 |
| 3,306,434 | 2/1967 | McConnell | 198/774 |
| 3,358,385 | 12/1967 | Maberry | 34/164 |
| 3,420,357 | 1/1969 | Eck | 198/774 |
| 3,557,942 | 1/1971 | Simon | 198/774 |
| 3,722,662 | 3/1973 | Wakabayashi et al. | 198/774 |
| 3,802,553 | 4/1974 | Schrawder | 198/773 |
| 4,040,514 | 8/1977 | Pielsticker et al. | 198/774 |

*Primary Examiner*—Henry C. Yuen

*Attorney, Agent, or Firm*—Hill, Gross, Simpson, Van Santen, Steadman, Chiara & Simpson

[57] ABSTRACT

A grid cooler for cooling hot material such as cement clinker issuing from a rotating cement kiln including a generally horizontal movable cooling grid with stationary elements and horizontally and vertically movable elements, housing enclosing the grid with an inlet chamber extending over the kiln, sidewalls on the housing and vertically adjustable brackets on the sidewalls with cross shafts and vertical support pedestals on the cross shafts with the pedestal for the movable grid including an inclined cam arrangement, and a drive for the movable grid with pivotal support arms supporting the discharge end of the grid about an axis substantially coincident with the plane of the grid so that the angle of inclination of the grid may be adjusted by swinging the receiving end of the grid up and down and the grid pivoting about its discharge end.

15 Claims, 2 Drawing Figures

Figure 1:
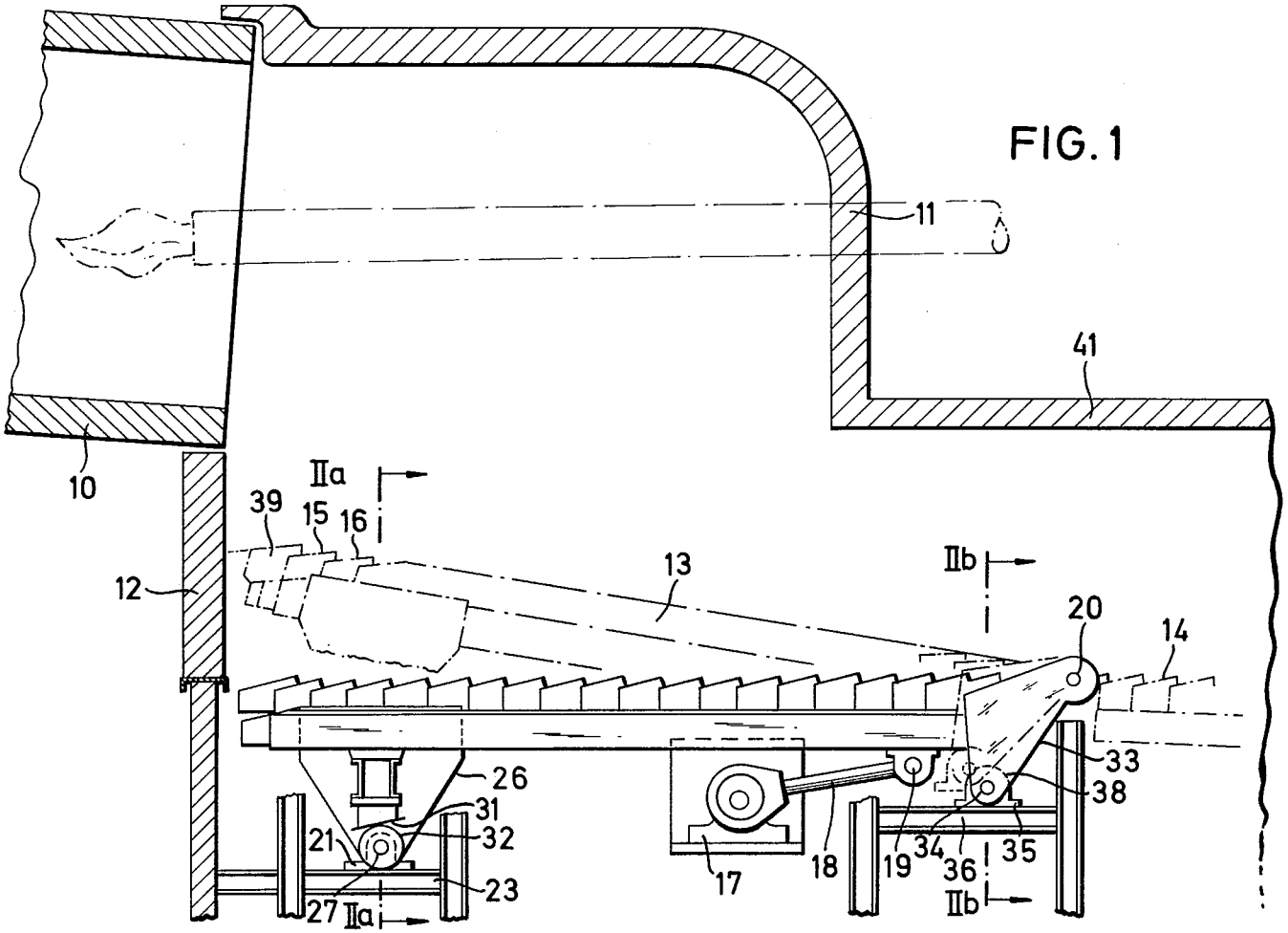

41
11
14
20
33
38
35
36
34
19
18
17
13
26
31
32
23
21
27
16
15
39
12
10
IIa
IIb

GRID COOLER, PARTICULARLY FEED STEP GRID COOLER

BACKGROUND OF THE INVENTION

The invention relates to a grid cooler, particularly of the type which may be termed a feed step grid cooler with cooling opening therethrough so that cement clinker falling on the grid moves forward on the inclined grid and is cooled thereon.

Feed step grid coolers of this type include alternately stationary and movable perforated grid elements where the air flows upwardly through the heated material on the upper surface. Rows of stationary grid plates are fixedly connected with a base of the cooler housing. Movable rows of intermittent grid plates are supported on the housing and driven by an eccentric drive usually installed outside of the base of the housing. Inasmuch as the grid is inclined, oscillating movement of the movable rows of grid plates cause the material to be cooled to flow down over the surface of the cooling grid while air moves upwardly through the material, and the material is received at the receiving or upper edge of the grid and is discharged at the lower or discharge edge of the grid onto another grid.

It has been a practice before to support several cooling grids consecutively in a cooler housing and to construct the first cooling grid in an inclined manner as, for example, as shown in German Pat. No. 1,170,307. It has also been a practice to provide different feeding speeds to the individual cooling grid in order to produce a different thickness in the bed of the material to be cooled. This method of regulation of cooling is utilizable to a limited extent. It does not take into account fluctuations in the average granular size of the material to be cooled as occurs in the case of cement clinkers. Accordingly, when the average clinker size is altered by virtue of altering the calcining operations and the cement clinker grain size becomes substantially greater or smaller, the flow behavior of the material on the grid changes. In addition other qualities which affect either the flow behavior or the cooling effect of the air moving up through the material will occur which are not controllable to attain the proper cooling solely through alteration of the speed of feed of the material.

An arrangement which has been attempted for control of flow behavior of cement clinker on inclined grid cooler has been to curve the feed edge of the grid plates upwardly so that the grid plates are approximately synclinal, as shown in German Pat. No. 952,785. With this more expensive arrangement, the height of the clinker bed on the cooling bed, however, does not permit itself to be adjusted to optimum depth.

It is an object of the present invention to provide a simplified and improved grid cooler in which the depth of the material bed located on the cooling grid is optimumly adjustable even with greatly fluctuating character of the granules of the material and type of material being received from the kiln.

A further object of the invention is to provide an improved grid cooler which meets the foregoing objective and where the entire cooling grid inclination can be changed without adversely affecting the other operating qualities of the grid.

In a grid cooler constructed and operating in accordance with the principles of the present invention, the stationary grid plates are no longer connected fixedly with the base portion of the housing of the cooler as they were heretofore, but the cooling grid as a whole is changed by raising or lowering the grid plate about a pivotal axis which is located coincident with the upper surface of the discharge end of the grid. The angle of incline of the grid can be changed from a horizontal or slightly inclined material feed plane to one which has a substantial inclination. With this construction, adaptations can be made during operation even with a substantially fluctuating character of clinker grain size and the height of the clinker bed on the cooling grid is adjustable to its optimum depth in such a manner that the cooling air absorbs as much heat as possible from the hot clinker. If the clinker grain is finer and the clinker material flow more rapidly or more strongly on the grid then the angle of inclination can be diminished. Similarly, if the clinker becomes more coarse and the clinker flow reduces, the angle of inclination can be increased. Changing charging mixture of clinker through the grid cooler are similarly more easily controllable in accordance with the principles of the invention. The mechanism for control or regulation of the speed of feed of material onto the cooling grid then is not necessary and its size and expense may be eliminated. However, in some instances, such control may be incorporated with the principles of the present invention to obtain an even greater optimum performance of the clinker cooling mechanism.

Other objects, advantages and features, as well as equivalent principles and structures, which are intended to be covered herein, will become more apparent from the teaching of the principles of the present invention in connection with the disclosure of the preferred embodiments in the specification, claims and drawings, in which:

DRAWINGS

Figure 2:
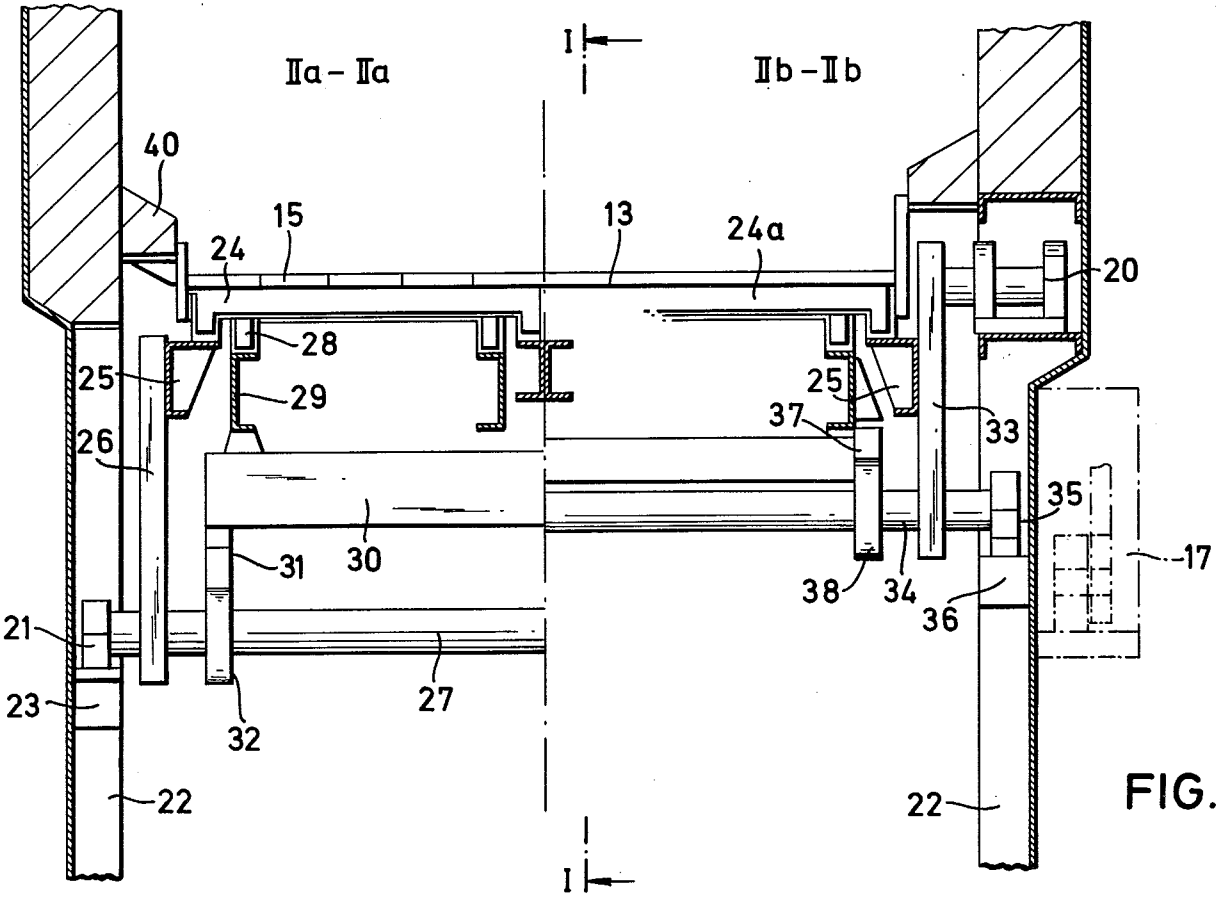

FIG. 1 is a somewhat schematic vertical longitudinal sectional view taken through the grid cooler constructed in accordance with the present invention with the section taken generally along line I—I of FIG. 2; and FIG. 2 is a vertical cross sectional view taken laterally across the mechanism of FIG. 1 generally along a line IIa—IIa for the lefthand portion of FIG. 2, and along a line IIb—IIb of FIG. 1 for the righthand portion of the drawing.

DESCRIPTION

As shown in FIG. 1, hot cement clinker after being processed falls out of the discharge end of a rotary kiln 10 and into the inlet chamber 11 of a feed step grid cooler. The cooler has a housing 12 in which are supported a first cooling grid 13 and at least one additional further cooling grid 14. The grid arrangement, as shown with the cooling grid 13 includes alternately stationary and movable rows of grid plates 15 and 16 which have bores for the upward flow of cooling air through the material moving along the top of the grid plates.

The grid plates are fixed on corresponding stationary and movable support beams which extend transversely to the direction of material feed, with the plates extending in the direction of material feed. All movable support beams are attached to a feed carriage which is moved back and forth with a predetermined stroke. By means of the reciprocating movement of the feed carriage, the hot cement clinker on the top of the somewhat overlapping transverse rows of grid plates is fed step by step to the cooler discharge moving from left to right as shown on the drawing. The drive of the feed carriage and consequent movement of the movable grid plates is achieved by operation of an eccentric drive motor 17 which is suitably mounted on the outside of the cooler housing and has a connecting rod 18 on a shaft 19 which passes through and is sealed to the wall so that the drive can occur.

In accordance with the principles of the invention, the position of the entire cooling grid 13 is arranged so that its angle of inclination from the receiving edge just below the kiln 10 to the discharge edge at the location of its pivotal support 20. 20 provides a hinged support lying in the plane of the upper surface of the grid, and the angle of inclination is changed by raising or lowering the receiving end.

It is a feature of the invention that the pivotal axis of the support shaft 20 is positioned at the material discharge end at the height of the grid level. One advantage attained by this construction is that the gap at the overlapping connection point between the first grid 13 and the second grid 14 remains the same. That is, as the material flows downwardly to the discharge edge of the first grid, it must flow onto the receiving end of the second grid 14 and the relationship between these two edges remains essentially the same even with adjustment of the inclination of the grid 13.

FIG. 1 illustrates the cooling grid 13 in a horizontal position in the solid line portion of the drawing and the dash-dot lines show the grid in an inclined position at which the flow off speed of the cement clinker is increased. By adjustment between these positions and an even more inclined position, it is possible to retain during operation optimal height of the clinker bed. Optimal height permits a depth of clinker bed at which the cooling air absorbs as much heat as possible from the hot clinker. This cooling air flow upwardly from below through the openings in the grid, up through the clinker bed and into the kiln 10. A part of this heated air which has passed through the clinker bed is introduced as secondary air into the rotary kiln 10. Thus, control of the entire operation of the mechanism including operation of the kiln is attainable inasmuch as the cooling of the clinker has an effect on the temperature of the air as it flows up through the bed, and the temperature of this air is related to the operation of the kiln 10. Once the angle of inclination of the cooling bed is adjusted, it is optimal only for a predetermined characteristic of granules coming out of the kiln, and this may fluctuate substantially to changing conditions in the kiln. By continual change of the clinker bed inclination, the changing composition of the pulverized raw material coming from the kiln can be accommodated for optimum through put and improved quality of material received.

FIG. 2 illustrates the relative location of the cooling grid 13 in the base of the cooler housing. The cooling grid is supported at its material inlet end on supporting mounts or pedestals 21. These are adjustably supported as to their height on a sidewall 22 of the housing. The supporting pedestal 21 is supported on a bracket 23 on the wall. If the cooling grid is to be adjusted to a greater angle of inclination, its receiving end is raised by means of a power lifting system of suitable construction, not shown such as, for example, by hydraulic cylinders. These hydraulic cylinders will elevate or lower the brackets 23.

The stationary grid plates have supports 24 and these are hingedly supported on a channel iron 25 which is carried on a supporting pedestal 26 which extends down and is connected to a cross shaft 27. The cross shaft connects the supporting pedestals 21 on each side of the machine to each other, and the pedestal portions 21 are supported on similar brackets on the opposite sidewalls 22 of the housing. By virtue of the hinged support connection between the supports 24 and the channel irons 25, the receiving edge of the cooling grid may be freely elevated or lowered about the pivotal axis 20 at the discharge end of the grid. For the movable plates, supports 28 are located between the stationary grid plate supports 24. The supports 28 for the movable grid plates are carried on channel irons 29. Transverse support beams carry the channel irons and beams 30 are mounted on an inclined cam surface 31 which rests on a roller 32. The roller 32 is mounted on the cross shaft 27. Thus, as the movable grid plate assembly moves to and fro fore and aft of the direction of the grid, it moves up and down in its oscillating movement to tend to move the material on the grid in a forward advancing direction. It will be seen that vertical adjustment of the brackets 23 adjust the vertical height of the receiving end of the entire grid assembly including both the movable and stationary plates.

On the material discharge end of the cooling grid 13, it is pivoted on a supporting arm 33. The supporting arm is pivotally secured at point 20 to the grid at its upper end, and is pivotally supported at its lower end to a connecting shaft 34 which extends transversely of the machine as illustrated in FIGS. 1 and 2. The shaft is mounted on supporting pedestals 35 which are vertically adjustable by being carried on adjustable brackets 36 mounted on the housing sidewalls. When the grid is pivoted upwardly, the arms 20 will be pivoted in a clockwise or forward direction as indicated by the dotted line position of FIG. 1, and the brackets therefore, are then set correspondingly higher. The arm 20 is relieved of the weight of the cooling grid for normal continued operation of the grid. FIG. 2 at the righthand side indicates essentially that the pivotal location of the pivot point 20 is fixed, and the brackets 36 are elevated as the arm 33 is pivoted, maintaining the shaft 34 in proper operating position for support of the movable grid plates. The support of the material discharge end of the cooling grid is constructed similarly to the support of the material receiving end. Thus, the stationary grid plate supports 24 are connected through the channel iron 25 fixedly with the supporting arm 33, while the movable plates are supported through inclined surfaces 37 on rolls 38 of the connecting shaft 34.

As the angle of inclination of the cooling grid 13 is increased, the gap between the first grid plate row 39 and the adjacent cooler housing wall 12 is increased. This first row of grid plates together with the plate support is constructed slidably in the plane of the plates in order to be able to close the resulting gap. The possibility of the cement clinker falling downwardly into the base of the housing is, therefore, prevented. The further gap between the cooler housing and cooling grid 13 as it is altered in inclination, is sealed after each change in the angle of incline of the cooling grid by means of a fireproof brick work 40. This, likewise, prevents a dropping of the clinker down into the base of the housing. The eccentric driving motor 17 is supported by suitable brackets on the sidewall of the housing for continued drive of the feed carriage with shifting of the angle of inclination of the cooling grid 13.

As illustrated in FIG. 1, between the rotary kiln 10 and the clinker cooler, there is not an ordinary driving furnace head, but is an added on portion shown at 41 of the cooler housing. The cooler inlet chamber 11 is equipped with a door for access or inspection with a very wide cross-section opening which extends in the clinker transporting direction into the cooler. Therefore, advantages are attained in that the wide cross-section of the opening overlaps to a substantial extent for the recuperation zone which is the area of the cooling grid through which the cooling air flows as secondary air into the furnace. The speed of the secondary air current flowing in a straight line through the relatively wise cross-sectional area is comparatively low. This prevents the danger that the remaining secondary air stream which flows through the cooling grid in the area of the axis of pivotal support 20, and which is deflected from the housing ceiling 20 in the direction of the rotary kiln would draw along with it clinker dust. This construction, in addition to the foregoing advantage of low velocity air flow, also results in a relatively low dropping height of the clinker from the kiln to the cooling grid. The low dropping height and the low velocity of air flow reduce the development of dust. The low height of clinker drop also coacts with the need for reduction of load on the adjusting mechanism for the changing of the cooling grid angle of inclination.

It would be possible to control the lifting system for changing the inclination of the grid 13 with the pivotal axis of support at another location which is dependent upon the height of the clinker bed on the grid and also dependent upon the secondary air temperature entering the rotary kiln. This arrangement would be utilizable not only with a feed step grid cooler with movable plates but also with a cooler of the type having an endless grid belt or with an inclined grid cooler which does not oscillate, but feeds as a chute.

Thus, it will be seen that we have provided an improved grid cooler which meets the objectives and advantages above set forth, effects an improved product and reduced clinker dust and accommodation for varying change in speeds of operation and types of material being processed.

We claim as our invention:

1. A grid cooler for cooling hot material such as cement clinker issuing from a rotary kiln comprising in combination:

a generally horizontal movable cooling grid having an upper support surface and having openings for the upward passage of air through material flowing across the grid on said support surface from a receiving end to a discharge end and being inclined downwardly from the receiving to the discharge end;

and means for changing the angle of inclination from the receiving to the discharge end so that variations in material and temperatures may be compensated for in increasing or decreasing movement of material on the grid.

2. A grid cooler for cooling hot material such as cement clinker issuing from a rotary kiln constructed in accordance with claim 1:

wherein said cooling grid is provided with a pivotal support at the discharge end and moves pivotally about the axis of the support at the discharge end and has means for moving vertically at the receiving end for changing its angle of inclination.

3. A grid cooler for cooling hot material such as cement clinker issuing from a rotary kiln constructed in accordance with claim 2:

wherein the axis of pivotal movement at the discharge end lies in the plane of the upper support surface of the grid.

4. A grid cooler for cooling hot material such as cement clinker issuing from a rotary kiln constructed in accordance with claim 2:

including a housing enclosing the upper surface of the grid with said housing having stationary vertical sidewalls at each side of the grid and first supporting members supporting the grid at its adjusted elevation and adjustable relative to the sidewalls for changing said angle of inclination.

5. A grid cooler for cooling hot material such as cement clinker issuing from a rotary kiln constructed in accordance with claim 4:

wherein the supporting members are mounted on the sidewalls and second supporting members extend upwardly from the first supporting members and inwardly therefrom connecting between the first supporting members and the grid.

6. A grid cooler for cooling hot material such as cement clinker issuing from a rotary kiln constructed in accordance with claim 5:

including a cross connecting shaft secured to the first supporting members and adjustable therewith with the second supporting members connected to the shaft.

7. A grid cooler for cooling hot material such as cement clinker issuing from a rotary kiln constructed in accordance with claim 2:

wherein the pivotal axis of support for the discharge end of the grid is mounted on vertically adjustable supporting members located adjacent the axis.

8. A grid cooler for cooling hot material such as cement clinker issuing from a rotary kiln constructed in accordance with claim 7:

including a supporting arm connected to the grid at the pivotal axis and connected to the vertically adjustable support member.

9. A grid cooler for cooling hot material such as cement clinker issuing from a rotary kiln constructed in accordance with claim 1:

including a housing for the grid enclosing the grid and providing an enclosure for movement of material across the grid with sidewalls having a gap between the sidewalls and grid, and brick work supported on the sidewalls extending between the walls and sides of the grid.

10. A grid cooler for cooling hot material such as cement clinker issuing from a rotary kiln constructed in accordance with claim 1:

including a housing for the grid with an overhead inlet chamber having a broad inlet opening providing a maximum overlap for the area above the grid where material being cooled flows.

11. In a rotary cement processing kiln having a cement clinker discharge kiln end, a grid cooler for cooling material coming from the kiln comprising:

a generally horizontal movable cooling grid with stationary elements and relatively movable elements for the movement of material across the grid with said grid positioned beneath the discharge of a rotary kiln and having a receiving end and a discharge end;

means for driving the movable elements in movement relative to the stationary elements;

a housing for the grid having an inlet chamber extending to enclose the discharge end of the kiln and having sidewalls;

support members on the sidewalls for supporting the receiving end and the discharge end of the grid with said support members being vertically adjustable on the sidewalls;

first and second means on the support members respectively supporting the stationary elements and the movable elements of the grid;

a support arm secured to the support members and connected to the discharge end of the grid mounting it for pivotal adjustable movement about an axis coincident with the plane of flow of material across the grid and the discharge end of the grid so that the angle of inclination of the grid may be adjusted by elevating or lowering the receiving end about said axis.

12. In a rotary cement processing kiln having a cement clinker discharge kiln end, a grid cooler for cooling material coming from the kiln constructed in accordance with claim 11:

including cross shafts extending transversely of the grid for tieing the support members together at each side of the grid.

13. In a rotary cement processing kiln having a cement clinker discharge kiln end, a grid cooler for cooling material coming from the kiln constructed in accordance with claim 11:

wherein the drive for the movable elements of the grid is vertically adjustable in position on the sidewalls.

14. In a rotary cement processing kiln having a cement clinker discharge kiln end, a grid cooler for cooling material coming from the kiln constructed in accordance with claim 11:

including means for relieving the weight of the discharge end of the grid on said arms during operation of the grid.

15. In a rotary cement processing kiln having a cement clinker discharge kiln end, a grid cooler for cooling material coming from the kiln constructed in accordance with claim 11:

including cross shafts on the support members for the receiving end of the grid, vertical supports on the cross shafts supporting the stationary elements of the grid, vertical support members on the cross shafts supporting the movable elements of the grid and including an angled cam surface whereby the movable grid elements have vertical movement and are driven by the drive in horizontal movement.

* * * * *